US005497173A

United States Patent [19]

Hughes

[11] Patent Number: 5,497,173

[45] Date of Patent: Mar. 5, 1996

[54] METHOD AND APPARATUS FOR MULTIPLEX ADDRESSING OF A FERRO-ELECTRIC LIQUID CRYSTAL DISPLAY

[75] Inventor: Jonathan R. Hughes, Worcester, England

[73] Assignee: The Secretary of State for Defence in Her Britannic Majesty's Government of the United Kingdom of Great Britain and Northern Ireland, London, England

[ * ] Notice: The term of this patent shall not extend beyond the expiratin date of Pat. No. 5,398,042.

[21] Appl. No.: 231,917

[22] Filed: Apr. 25, 1994

Related U.S. Application Data

[63] Continuation of Ser. No. 488,028, filed as PCT/GB88/01004, Nov. 10, 1988, Pat. No. 5,348,042.

[30] Foreign Application Priority Data

Nov. 18, 1987 [GB] United Kingdom ..... 8726996

[51] Int. Cl.[6] ..... G09G 3/36

[52] U.S. Cl. ..... 345/94; 345/97

[58] Field of Search ..... 345/97, 95, 101, 345/94, 96, 87, 92; 359/54, 56, 58, 59

[56] References Cited

U.S. PATENT DOCUMENTS

| | | | |
|---|---|---|---|
| 4,367,924 | 1/1983 | Clark et al. . | |
| 4,536,059 | 8/1985 | van den Berk . | |
| 4,625,204 | 11/1986 | Clerc | 340/784 |
| 4,681,404 | 7/1987 | Okada et al. . | |
| 4,705,345 | 11/1987 | Ayliffe et al. . | |
| 4,712,873 | 12/1987 | Kanbe et al. . | |
| 4,720,173 | 1/1988 | Okada et al. . | |
| 4,722,594 | 2/1988 | Crossland et al. . | |
| 4,728,947 | 3/1988 | Ayliffe et al. . | |
| 4,850,676 | 7/1989 | Yazaki et al. . | |
| 4,909,107 | 3/1990 | Ross . | |

(List continued on next page.)

FOREIGN PATENT DOCUMENTS

| | | |
|---|---|---|
| 2163273 | 2/1986 | United Kingdom . |
| 2173629 | 10/1986 | United Kingdom . |
| 2175725 | 12/1986 | United Kingdom . |
| 2209610 | 7/1990 | United Kingdom . |
| A186/05003 | 8/1986 | WIPO . |

OTHER PUBLICATIONS

SID 85 Digest, "An Application of Chiral Smectic–C Liquid Crystal to a Multiplexed Large–Area Display", T. Harada et al., SEIKO Instrument & Electronics, Ltd., Chiba, Japan.

1985 IEEE, 1985 International Display Research Conference, "Ferroelectric Liquid Crystals for Displays," S. T. Lagerwall et al.

The Effect of Biaxial Permittivity Tensor and Tilted Layer Geometries on the Switching of Ferroelectric Liquid Crystals, Towler et al.

*Primary Examiner*—Richard Hjerpe
*Assistant Examiner*—Chanh Nguyen
*Attorney, Agent, or Firm*—Nixon & Vanderhye

[57] ABSTRACT

A ferro-electric liquid crystal display is multiplex addressed by blanking and strobe waveforms applied in sequence to each electrode in one set of electrodes coincidentally with data waveforms applied to a second set of electrodes. Liquid crystal material in the display is switched by a d.c. pulse of appropriate polarity, amplitude and time. The strobe waveforms have a pulse pair comprising two pulses of different amplitude and the same or different sign. Data waveforms are rectangular waveforms of opposite sign. The amplitude and ratio of leading pulses to trailing pulses in each strobe pulse pair are adjusted to obtain the desired switching and contrast. Compensation for temperature changes is arranged by measuring the temperature of the liquid crystal material and using the value obtained to adjust the amplitude value of the leading pulse in each strobe pulse pair.

14 Claims, 9 Drawing Sheets

U.S. PATENT DOCUMENTS 4,917,469 4/1990 Ross ..... 350/332
4,969,719 11/1990 Bradshaw et al. .
4,997,264 3/1991 Coulson .
5,033,822 7/1991 Ooki ..... 350/331
5,285,214 2/1994 Bowry ..... 345/97
5,398,042 3/1995 Hughes ..... 345/94

METHOD AND APPARATUS FOR MULTIPLEX ADDRESSING OF A FERRO-ELECTRIC LIQUID CRYSTAL DISPLAY

This is a continuation of application Ser. No. 07/488,028, filed May 16, 1990, now U.S. Pat. No. 5,348,042, which is based on PCT/GB88/01004 filed Nov. 16, 1988.

BACKGROUND OF THE INVENTION

1. Field of the Invention

This invention relates to the multiplex addressing of ferro-electric liquid crystal displays. Such displays may use a chiral smectic, C, I, and F liquid crystal material.

2. Discussion of Prior Art

Liquid crystal display devices commonly comprise a thin layer of a liquid crystal material contained between two glass slides. Electrode structures on the inner faces of these slides enable an electric field to be applied across the liquid crystal layer thereby changing its molecular alignment. Many different types of displays have been made using nematic and cholesteric liquid crystal material. Both these types of material are operated between a field ON state and a field OFF state; i.e. displays are operated by switching a field on and off.

A more recent type of display uses a ferroelectric chiral smectic C, I, and F liquid crystal material in which liquid crystal molecules adopt one of two possible field ON states depending on the polarity of applied field. These displays are thus switched between the two states by pulses of appropriate polarity. In a zero applied field the molecules adopt an intermediate, configuration. Chiral smectic displays offer very fast switching with an amount of bistability. Examples of chiral smectic displays are described in G.B. No. 2,163,273, G.B. No. 2,159,635 (U.S. Pat. No. 4,713,873), G.B. No. 2,166,256 (U.S. Pat. No. 4,722,594), G.B. No. 2,157,451 (U.S. Pat. No. 4,720,173), U.S. Pat. No. 4,536,059, U.S. Pat. No. 4,367,924, G.B. P.A. No. 86 08,114—P.C.T. No. G.B. 87/00,222 (GB 2,209,610 corresponds to U.S. Ser. No. 07/279,553), G.B. P.A. No. 08,115—P.C.T. No. 87/00,221 (GB 2,210,468 corresponds to U.S. Pat. No. 4,969,719), G.B. P.A. No. 08,116—P.C.T. 87/00,220 (GB 2,210,469 corresponds to U.S. Pat. No. 4,997,264).

There are a number of known systems for multiplex addressing chiral smectic displays; see for example article by Harada et al 1985 S.I.D. Paper 8.4 pp 131–134, and Lagerwall et al 1985 I.D.R.C. pp 213–221. In this system a switching pulse is immediately preceeded by an equal and opposite polarity pulse which switches to the opposite state. The purpose of an opposite pulse followed by the wanted switching pulse is to ensure net d.c. at the liquid crystal material. See also GB 2,173,336A (U.S. Pat. No. 4,705,345) and GB 2,173,629 A.

A disadvantage of this system is a reduce switching time. Also the material sometimes fails to switch to the wanted state but stays in an opposite switched state. This gives inverted contrast which under certain conditions could be difficult to control in a complex display.

SUMMARY OF THE INVENTION

According to this invention a method of multiplex addressing a ferro electric liquid crystal matrix display formed by the intersections of a first set of electrodes and a second set of electrodes comprises the steps of:

applying a strobe waveform to each electrode in sequence in the first set of electrodes, said strobe waveform comprising a first pair of strobe pulses of different amplitude followed by a second pair of pulses of similar amplitude but different sign to the first pair of strobe pulses, applying one of two data waveforms to each electrode in the second set of electrodes coincidently with strobe waveform, both data waveforms being rectangular waveforms of alternate positive and negative values with one data waveform the inverse of the other data waveform, whereby each intersection is addressed with a d.c. pulse of appropriate sign and magnitude to turn that intersection to a desired display state once per complete display address period and an overall net zero d.c. value in each complete display address period.

According to this invention a multiplex addressed liquid crystal display comprises:

- a liquid crystal cell including a layer of ferro-electric smectic liquid crystal material contained between two walls each bearing a set of electrodes arranged to form collectively a matrix of addressable intersections,
- driver circuits for applying data waveforms to one set of electrodes and strobe waveforms to the other set of electrodes in a multiplexed manner,
- waveform generators for generating data and strobe waveforms for applying to the driver circuits,
- means for controlling the order of data waveforms so that a desired display pattern is obtained, Characterised by:

- a data waveform generator that generates two sets of waveforms of equal amplitude and frequency but opposite sign, each data waveform comprising d.c. pulses of alternate sign,
- a strobe waveform generator that generates strobe waveforms comprising a first pair of strobe pulses of different amplitude followed by a second pair of pulses of similar amplitude but different sign to the first pair of strobe pulses.

The strobe waveform may comprise two pairs of strobe pulses separated by a number of time periods when a zero strobe pulse is generated. Alternatively the second pair of strobe pulses may immediately follow the first pair.

Each pair of strobe pulses may be a pulse of one sign followed by a pulse of the opposite sign. Alternatively in each pair both strobe pulses may be of the same sign.

The amplitude of one strobe pulse in each pair is greater than, in any proportion, the amplitude of the other strobe pulse.

The amplitude of the smaller strobe pulse in each pair may be the same as or different from the amplitude of the data pulses.

The amplitude and sign of the leading pulse in each strobe pulse pair may be varied to provide satisfactory display operation over a wide range of temperatures.

BRIEF DESCRIPTION OF THE DRAWINGS

The invention will now be described by way of example only with reference to the accompanying drawings of which.

DETAILED DESCRIPTION OF PREFERRED EMBODIMENTS

Figure 1:
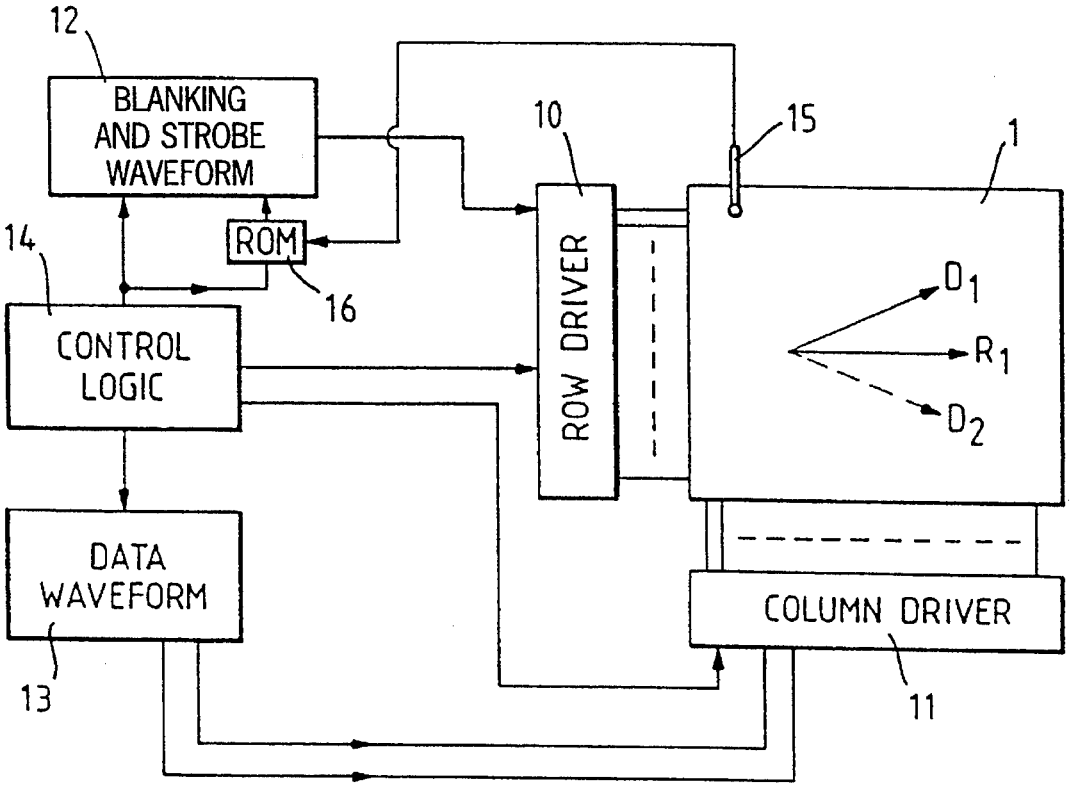
FIG. 1 is a diagrammatic view of a time multiplex addressed x, y matrix.
Figure 2:
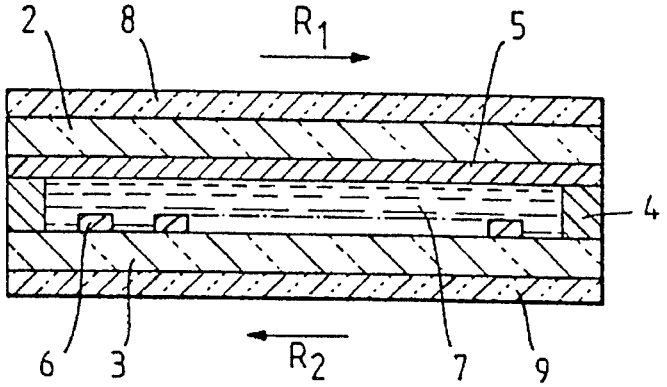
FIG. 2 is a cross section of part of the display of FIG. 1 to an enlarged scale.

The display 1 shown in FIGS. 1, 2 comprises two glass walls 2, 3 spaced about 1–6μm apart by a spacer ring 4 and/or distributed spacers.

Electrode structures 5, 6 of transparent tin oxide are formed on the inner face of both walls. These electrodes are shown as row and column forming an X, Y matrix but may be of other forms. For example, radial and curved shape for an r, θ display, or of segments form for a digital seven bar display.

A layer 7 of liquid crystal material is contained between the walls 2, 3 and spacer ring 4.

Polarises 8, 9 are arranged in front of and behind the cell 1. Row 10 and column 11 drivers apply voltage signals to the cell. Two sets of waveforms are generated for supplying the row and column drivers 10, 11. A blanking and strobe wave form generator 12 supplies row waveforms, and a data waveform generator 13 supplies ON and OFF waveforms to the column drivers 11. Overall control of timing and display format is controlled by a contrast logic unit 14. Temperature of the liquid crystal, layer 7, is measured by a thermocouple 15 whose output is fed to the blanking and strobe generator 12. The thermocouple 15 output may be direct to the generator or via a proportioning element 16 e.g. a programmed ROM chip to vary one part of the strobe pulse waveform.

Prior to assembly the walls 2, 3 are surface treated by spinning on a tin layer of polyamide or polyimide, drying and where appropriate curing; then buffing with a soft cloth (e.g. rayon) in a single direction $R_1$, $R_2$. This known treatment provides a surface alignment for liquid crystal molecules. The rubbing directions $R_1$, $R_2$ are antiparallel. When suitable unidirectional voltages are applied the molecules director align along one of two directors $D_1$, $D_2$ depending on polarity of the voltage. Typically the angle between $D_1$, $D_2$ is about 45°. In the absence of an applied electric field the molecules adopt an intermediate alignment directions $R_1$, $R_2$ and the directions $D_1$, $D_2$.

The device may operate in a transmissive or reflective mode. In the former light passing through the device e.g. from a tungsten bulb is selectively transmitted or blocked to form the desired display. In the reflective mode a mirror is placed behind the second polariser 9 to reflect ambient light back through the cell 1 and two polarisers. By making the mirror partly reflecting the device may be operated both in a transmissive and reflective mode.

Pleochroic dyes may be added to the material 7. In this case, only one polariser is needed and the layer thickness may be 4–10 μm.

Suitable liquid crystal materials are:

catalogue references BDH—SCE 3 available from BDH, Poole, Dorset, and 19.6% CM8 (49% CC1–51% CC4)+80.4% $H_1$

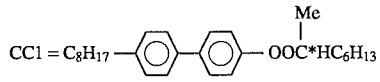

CC4 =

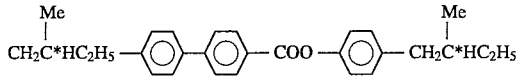

$H_1 = M_1 + M_2 + M_3$ (1:1:1)

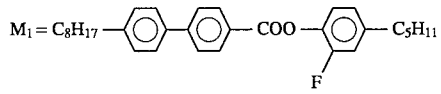

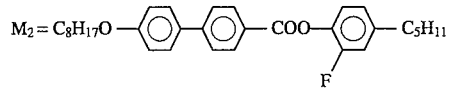

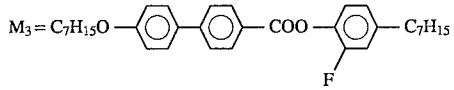

Another mixture is LPX 66=H1 (49.5%), AS 100 (49.5), IGS 97 (1%, H1=MB 8.5F+MB 80.5F+MB 70.7F (1:1:1) AS100=PYR 7.09+PYR 9.09 (1:2)

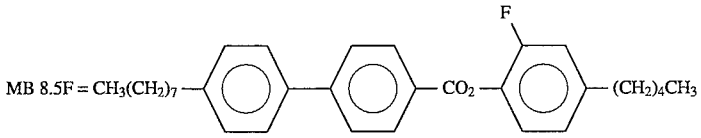

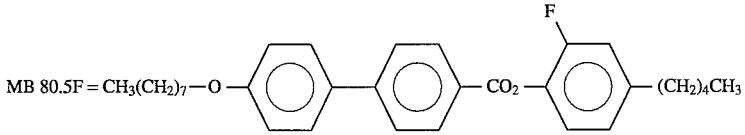

-continued

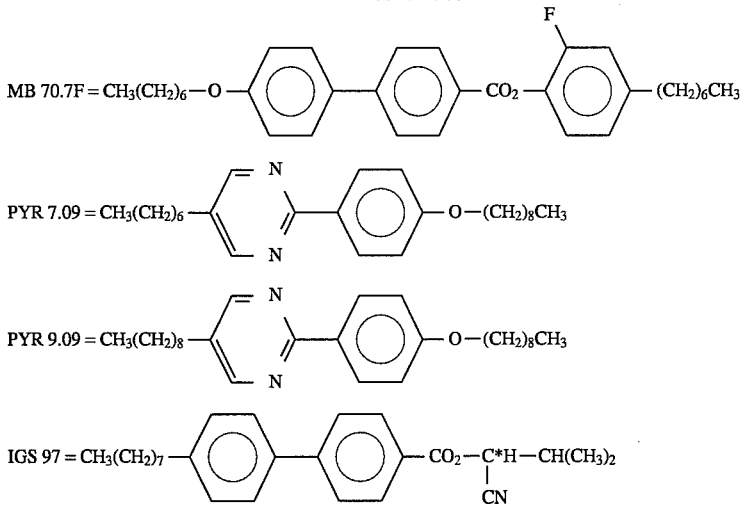

For a typical thickness of 2 μm this material at 22° C. is switched by a d.c. pulse of + or − 50 volts for 100 μs. The two switched states $D_1$, $D_2$ may be arbitrarily defined as ON after receiving a positive pulse and OFF after receiving a negative pulse of sufficient magnitude. Polarisers 8, 9 are arranged with their polarisation axes perpendicular to one another and with one of the axes parallel to the director in one of the switched states.

In operation strobe waveforms are applied to each row in turn whilst appropriate ON or OFF data waveform are applied to each column electrode. This provides a desired display pattern formed by some x, y intersection in an ON state and other in an OFF state. Such addressing is termed multiplex addressing. The present invention is distinguished from prior art systems by the shape of the applied waveforms.

Figure 3:
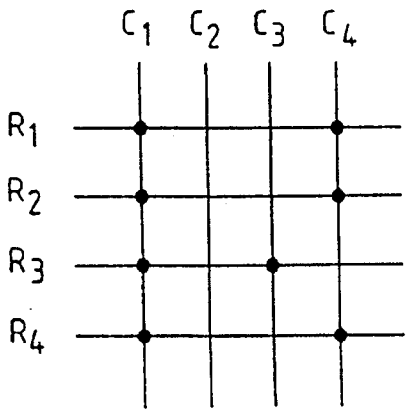
FIG. 3 is a view of an x, y matrix showing one pattern of ON elements.

FIG. 3 shows a 4 by 4 x, y matrix with ON intersections indicated by a solid circle, elsewhere the display is OFF.

Figure 4:
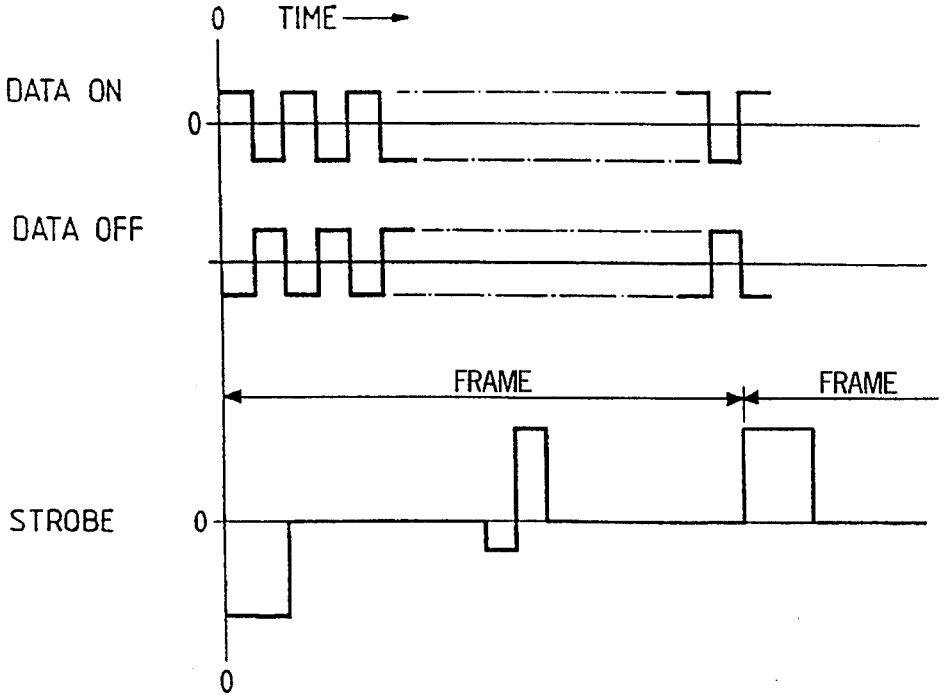
FIG. 4 shows data and strobe are waveform diagrams.

FIG. 4 shows the shape of data ON and OFF plus the shape of strobe waveforms. Each data and strobe pulse lasts for a period of one time slot. As seen the blanking and strobe waveform is formed a blanking pulse and a strobe pulse pair separated by a number of time slots where zero voltage is applied. These pairs are of opposite polarity. −3; blanking pulse is applied to a complete line, until the strobe pulse comprising a −1 volt pulse followed by a ∓pulse. A string of zero pulses completes the frame. A similar second frame follows with reversed polarity to prevent d.c. buildup. A display is addressed by both fields to provide the desired information. The length of the frames and hence the number of time slots between pairs of pulses is dependent on the number of rows to be addressed. A larger number of rows requires a large number of time slots between the pairs of pulses.

Waveforms applied to each row and column, and to the resulting value at each x, y intersection are shown in tabular form in Table 1. Row 1 is indicated by R1 etc; intersection of row 1 and column 1 is indicated by R1, $C_1$ etc.

Figure 5:
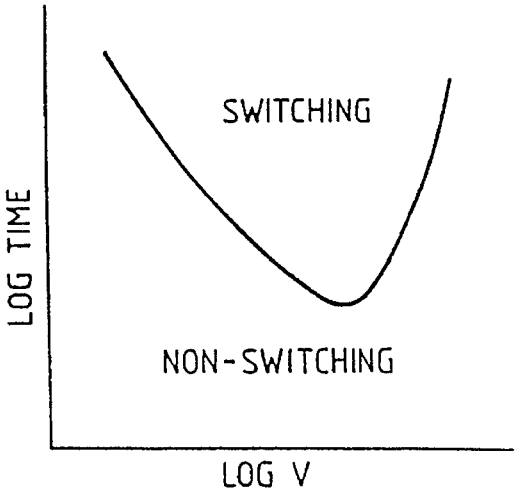
FIG. 5 is a graph showing a boundary between switching and non-switching values of time and applied voltage amplitude.

The values of applied voltage are adjusted such that +1 or −1 does not switch the display. A ±3 or more value will switch the display. However the chiral smetic is sensitive to the amplitude time product as shown in FIG. 5. Therefore it is necessary to ensure that when successive time slots are of the same polarity their amplitude time product does not exceed the threshold for switching. The manner in which both voltage and time effect switching is shown in FIG. 5; values, above the curve give a switch effect. Note, the curve indicates whether or not switching occurs from either ON or OFF state. The voltage values are modulus voltages.

For the row 1 column 1 intersection a −2 amplitude followed by −1 is obtained in the first field time. Thus the actual value of −2 needs to be kept as low as possible. At the beginning of field 2 a −2 is immediately followed by +4 which is high enough to give a clear switch to an ON state. Similarly, in row 1 column 2, a −4 value gives a clear switch to an OFF state.

Strobe waveforms having values other than ±1 and ±3 may be chosen, for example Table 1(b) shows the effect obtained with strobe pulses of 1, −2; −1, 2. Intersections receive maximum values of 3 proceeded by −2, or −3 preceeded by +2. The values −2, (or +2) start to turn the intersection to the OFF (or ON) state whilst the 3 (or −3) fully switches the intersection to the desired ON (or OFF) state.

Various other strobe waveforms and consequential intersection waveforms are shown in Tables 2 and 8.

Table 5–8 show how the two pairs of strobe pulses can be adjacent one another so that only one field is used per frame instead of the two fields of Tables 1 to 4. In all cases the relative values of each strobe pulse and data pulse amplitude can be varied from that shown. Values of 1 and 3 are merely by way of example only.

TABLE 1(a)

| | Time Data | | | | | | | | | | | | | | | | | |
|---|---|---|---|---|---|---|---|---|---|---|---|---|---|---|---|---|---|---|
| ON | 1 | −1 | 1 | −1 | 1 | −1 | 1 | −1 | 1 | −1 | 1 | −1 | 1 | −1 | 1 | −1 | 1 | −1 |

TABLE 1(a)-continued

| | | | | | | | | | | | | | | | | | | |
|---|---|---|---|---|---|---|---|---|---|---|---|---|---|---|---|---|---|---|
| OFF | −1 | 1 | −1 | 1 | −1 | 1 | −1 | 1 | −1 | 1 | −1 | 1 | −1 | 1 | −1 | 1 | −1 | 1 |
| Strobe | | | | | | | | | | | | | | | | | | |
| R1 | 1 | −3 | 0 | 0 | 0 | 0 | 0 | 0 | −1 | 3 | 0 | 0 | 0 | 0 | 0 | 0 | 1 | −3 |
| R2 | 0 | 0 | 1 | −3 | 0 | 0 | 0 | 0 | 0 | 0 | −1 | 3 | 0 | 0 | 0 | 0 | 0 | 0 |
| R3 | 0 | 0 | 0 | 0 | 1 | −3 | 0 | 0 | 0 | 0 | 0 | 0 | −1 | 3 | 0 | 0 | 0 | 0 |
| R4 | 0 | 0 | 0 | 0 | 0 | 0 | 1 | −3 | 0 | 0 | 0 | 0 | 0 | 0 | −1 | 3 | 0 | 0 |
| Waveform at column for the display of FIG. 3 | | | | | | | | | | | | | | | | | | |
| C1 | 1 | −1 | 1 | −1 | 1 | −1 | 1 | −1 | 1 | −1 | 1 | −1 | 1 | −1 | 1 | −1 | 1 | −1 |
| C2 | −1 | 1 | −1 | 1 | −1 | 1 | −1 | 1 | −1 | 1 | −1 | 1 | −1 | 1 | −1 | 1 | −1 | 1 |
| C3 | −1 | 1 | −1 | 1 | 1 | −1 | −1 | 1 | −1 | 1 | −1 | 1 | 1 | −1 | −1 | 1 | −1 | 1 |
| C4 | 1 | −1 | 1 | −1 | −1 | 1 | 1 | −1 | 1 | −1 | 1 | −1 | −1 | 1 | 1 | −1 | 1 | −1 |
| Waveform at x,y intersection for the display of FIG. 3 | | | | | | | | | | | | | | | | | | |
| R1C1 | 0 | −2 | −1 | 1 | −1 | 1 | −1 | 1 | −2 | 4 | −1 | 1 | −1 | 1 | −1 | 1 | 0 | −2 |
| R2C2 | 1 | −1 | 2 | −4 | 1 | −1 | 1 | −1 | 1 | −1 | 0 | 2 | 1 | −1 | 1 | −1 | 1 | −1 |
| R3C3 | 1 | −1 | 1 | −1 | 0 | −2 | 1 | −1 | 1 | −1 | 1 | −1 | −2 | 4 | 1 | −1 | 1 | 1 |
| R3C4 | −1 | 1 | −1 | 1 | 2 | −4 | −1 | 1 | −1 | 1 | −1 | 1 | 0 | 2 | −1 | 1 | −1 | 1 |

TABLE 1(b)

| | | | | | | | | | | | | | | | | | | |
|---|---|---|---|---|---|---|---|---|---|---|---|---|---|---|---|---|---|---|
| Data | | | | | | | | | | | | | | | | | | |
| ON | 1 | −1 | 1 | −1 | 1 | −1 | 1 | −1 | 1 | −1 | 1 | −1 | 1 | −1 | 1 | −1 | 1 | −1 |
| OFF | −1 | 1 | −1 | 1 | −1 | 1 | −1 | 1 | −1 | 1 | −1 | 1 | −1 | 1 | −1 | 1 | −1 | 1 |
| Strobe | | | | | | | | | | | | | | | | | | |
| R1 | 1 | −2 | 0 | 0 | 0 | 0 | 0 | 0 | −1 | 2 | 0 | 0 | 0 | 0 | 0 | 0 | 1 | −2 |
| R2 | 0 | 0 | 1 | −2 | 0 | 0 | 0 | 0 | 0 | 0 | −1 | 2 | 0 | 0 | 0 | 0 | 0 | 0 |
| R3 | 0 | 0 | 0 | 0 | 1 | −2 | 0 | 0 | 0 | 0 | 0 | 0 | −1 | 2 | 0 | 0 | 0 | 0 |
| R4 | 0 | 0 | 0 | 0 | 0 | 0 | 1 | −2 | 0 | 0 | 0 | 0 | 0 | 0 | −1 | 2 | 0 | 0 |
| Waveform at x,y intersection for the display of FIG. 3 | | | | | | | | | | | | | | | | | | |
| R1C1 | 0 | −1 | −1 | 1 | −1 | 1 | −1 | 1 | −2 | 3 | −1 | 1 | −1 | 1 | −1 | 1 | 0 | −1 |
| R2C2 | 1 | −1 | 2 | −3 | 1 | −1 | 1 | −1 | 1 | −1 | 0 | 1 | 1 | −1 | 1 | −1 | 1 | −1 |
| R3C3 | 1 | −1 | 1 | −1 | 0 | −1 | 1 | −1 | 1 | −1 | 1 | −1 | −2 | 3 | 1 | −1 | 1 | −1 |
| R3C4 | −1 | 1 | −1 | 1 | 2 | −3 | −1 | 1 | −1 | 1 | −1 | 1 | 0 | 1 | −1 | 1 | −1 | 1 |

TABLE 2

| | | | | | | | | | | | | | | | | | | |
|---|---|---|---|---|---|---|---|---|---|---|---|---|---|---|---|---|---|---|
| Data | | | | | | | | | | | | | | | | | | |
| ON | −1 | 1 | −1 | 1 | −1 | 1 | −1 | 1 | −1 | 1 | −1 | 1 | −1 | 1 | −1 | 1 | −1 | 1 |
| OFF | 1 | −1 | 1 | −1 | 1 | −1 | 1 | −1 | 1 | −1 | 1 | −1 | 1 | −1 | 1 | −1 | 1 | −1 |
| Strobe | | | | | | | | | | | | | | | | | | |
| R1 | −3 | 1 | 0 | 0 | 0 | 0 | 0 | 0 | 3 | −1 | 0 | 0 | 0 | 0 | 0 | 0 | −3 | 1 |
| R2 | 0 | 0 | −3 | 1 | 0 | 0 | 0 | 0 | 0 | 0 | 3 | −1 | 0 | 0 | 0 | 0 | 0 | 0 |
| R3 | 0 | 0 | 0 | 0 | −3 | −1 | 0 | 0 | 0 | 0 | 0 | 0 | 3 | −1 | 0 | 0 | 0 | 0 |
| R4 | 0 | 0 | 0 | 0 | 0 | 0 | −3 | 1 | 0 | 0 | 0 | 0 | 0 | 0 | 3 | −1 | 0 | 0 |
| Waveform at column for the display of FIG. 3 | | | | | | | | | | | | | | | | | | |
| C1 | −1 | 1 | −1 | 1 | −1 | 1 | −1 | 1 | −1 | 1 | −1 | 1 | −1 | 1 | −1 | 1 | −1 | 1 |
| C2 | 1 | −1 | 1 | −1 | 1 | −1 | 1 | −1 | 1 | −1 | 1 | −1 | 1 | −1 | 1 | −1 | 1 | −1 |
| C3 | 1 | −1 | 1 | −1 | 1 | 1 | 1 | −1 | 1 | −1 | 1 | −1 | −1 | 1 | 1 | −1 | 1 | −1 |
| C4 | −1 | 1 | −1 | 1 | −1 | −1 | −1 | 1 | −1 | 1 | −1 | 1 | 1 | −1 | −1 | 1 | −1 | 1 |
| Waveform at x,y intersection for the display of FIG. 3 | | | | | | | | | | | | | | | | | | |
| R1C1 | −2 | 0 | 1 | −1 | 1 | −1 | 1 | −1 | 4 | −2 | 1 | −1 | 1 | −1 | 1 | −1 | −2 | 0 |
| R2C2 | −1 | 1 | −4 | 2 | −1 | 1 | −1 | 1 | −1 | 1 | 2 | 0 | −1 | 1 | −1 | 1 | −1 | 1 |
| R3C3 | −1 | 1 | −1 | 1 | −2 | 0 | −1 | 1 | −1 | 1 | −1 | 1 | 4 | −2 | −1 | 1 | −1 | 1 |
| R3C4 | 1 | −1 | 1 | −1 | −4 | 2 | 1 | −1 | 1 | −1 | 1 | −1 | 2 | 0 | 1 | −1 | 1 | −1 |

TABLE 3

| | | | | | | | | | | |
|---|---|---|---|---|---|---|---|---|---|---|
| | | | | Data | | | | | | |
| ON | 1 | −1 | 1 | −1 | 1 | −1 | 1 | −1 | 1 | −1 |
| OFF | −1 | 1 | −1 | 1 | −1 | 1 | −1 | 1 | −1 | 1 |
| | | | | Strobe | | | | | | |
| R1 | −1 | −3 | 0 | 0 | 0 | 0 | 0 | 0 | 1 | 3 |
| R2 | 0 | 0 | −1 | −3 | 0 | 0 | 0 | 0 | 0 | 0 |
| R3 | 0 | 0 | 0 | 0 | −1 | −3 | 0 | 0 | 0 | 0 |
| R4 | 0 | 0 | 0 | 0 | 0 | 0 | −1 | −3 | 0 | 0 |
| | Waveforms at x,y intersections for the display of FIG. 3 | | | | | | | | | |
| R1C1 | −2 | −2 | −1 | 1 | −1 | 1 | −1 | 1 | 0 | 4 |
| R2C2 | 1 | −1 | 0 | −4 | 1 | −1 | 1 | −1 | 1 | −1 |
| R3C3 | 1 | −1 | 1 | −1 | −2 | −2 | 1 | −1 | −1 | 1 |
| R3C4 | −1 | 1 | −1 | 1 | 0 | −4 | −1 | 1 | −1 | 1 |
| | | | | Data | | | | | | |
| ON | 1 | −1 | 1 | −1 | 1 | −1 | 1 | −1 | 1 | −1 |
| OFF | −1 | 1 | −1 | 1 | −1 | 1 | −1 | 1 | −1 | 1 |
| | | | | Strobe | | | | | | |
| R1 | 0 | 0 | 0 | 0 | 0 | 0 | 0 | 0 | | |
| R2 | 1 | 3 | 0 | 0 | 0 | 0 | 0 | 0 | | |
| R3 | 0 | 0 | 1 | 3 | 0 | 0 | 0 | 0 | | |
| R4 | 0 | 0 | 0 | 0 | 1 | 3 | 0 | 0 | | |
| | Waveforms at x,y intersection for the display of FIG. 3 | | | | | | | | | |
| R1C1 | −1 | 1 | −1 | 1 | −1 | 1 | −2 | 2 | | |
| R2C2 | 2 | 2 | 1 | −1 | 1 | −1 | 1 | −1 | | |
| R3C3 | −1 | 1 | 0 | 4 | 1 | −1 | 1 | −1 | | |
| R3C4 | −1 | 1 | 2 | 2 | −1 | 1 | −1 | 1 | | |

TABLE 4

| | | | | | | | | | | |
|---|---|---|---|---|---|---|---|---|---|---|
| | | | | Data | | | | | | |
| ON | −1 | 1 | −1 | 1 | −1 | 1 | −1 | 1 | −1 | 1 |
| OFF | 1 | −1 | 1 | −1 | 1 | −1 | 1 | −1 | 1 | −1 |
| | | | | Strobe | | | | | | |
| R1 | −3 | −1 | 0 | 0 | 0 | 0 | 0 | 0 | 3 | 1 |
| R2 | 0 | 0 | −3 | −1 | 0 | 0 | 0 | 0 | 0 | 0 |
| R3 | 0 | 0 | 0 | 0 | −3 | −1 | 0 | 0 | 0 | 0 |
| R4 | 0 | 0 | 0 | 0 | 0 | 0 | −3 | −1 | 0 | 0 |
| | Waveforms at x,y intersections for the display of FIG. 3 | | | | | | | | | |
| R1C1 | −2 | −2 | 1 | −1 | 1 | −1 | 1 | −1 | 4 | 0 |
| R2C2 | −1 | 1 | −4 | 0 | −1 | 1 | −1 | 1 | −1 | 1 |
| R3C3 | −1 | 1 | −1 | 1 | −2 | −2 | −1 | 1 | −1 | |
| R3C4 | 1 | −1 | 1 | −1 | 1 | 0 | −4 | −1 | 1 | −1 |
| | | | | Data | | | | | | |
| ON | −1 | 1 | −1 | 1 | −1 | 1 | −1 | 1 | −1 | 1 |
| OFF | 1 | −1 | 1 | −1 | 1 | −1 | 1 | −1 | 1 | −1 |
| | | | | Strobe | | | | | | |
| R1 | 0 | 0 | 0 | 0 | 0 | 0 | 0 | 0 | | |
| R2 | 3 | 1 | 0 | 0 | 0 | 0 | 0 | 0 | | |
| R3 | 0 | 0 | 3 | 1 | 0 | 0 | 0 | 0 | | |
| R4 | 0 | 0 | 0 | 0 | 3 | 1 | 0 | 0 | | |
| | Waveforms at x,y intersection for the display of FIG. 3 | | | | | | | | | |
| R1C1 | 1 | −1 | 1 | −1 | 1 | −1 | −2 | −2 | | |
| R2C2 | 2 | 2 | −1 | 1 | −1 | 1 | 1 | −1 | 1 | |
| R3C3 | −1 | 1 | 4 | 0 | −1 | 1 | −1 | 1 | | |
| R3C4 | 1 | −1 | 2 | 2 | 1 | −1 | 1 | −1 | | |

TABLE 5

| | | | | | | | | | | | |
|---|---|---|---|---|---|---|---|---|---|---|---|
| | | | | Data | | | | | | | |
| ON | 1 | −1 | 1 | −1 | 1 | −1 | 1 | −1 | 1 | −1 | 1 |
| OFF | −1 | 1 | −1 | 1 | −1 | 1 | −1 | 1 | −1 | 1 | −1 |
| | | | | Strobe | | | | | | | |
| R1 | 1 | −3 | −1 | 3 | 0 | 0 | 0 | 0 | 0 | 0 | 0 |
| R2 | 0 | 0 | 0 | 0 | 1 | −3 | −1 | 3 | 0 | 0 | 0 |
| R3 | 0 | 0 | 0 | 0 | 0 | 0 | 0 | 0 | 1 | −3 | −1 |
| R4 | 0 | 0 | 0 | 0 | 0 | 0 | 0 | 0 | 0 | 0 | 0 |
| | Waveforms at x,y intersections for the display of FIG. 3 | | | | | | | | | | |
| R1C1 | 0 | −2 | −2 | 4 | −1 | 1 | −1 | 1 | −1 | 1 | −1 |
| R2C2 | 1 | −1 | 1 | −1 | 2 | −4 | 0 | 2 | 1 | −1 | 1 |
| R3C3 | 1 | −1 | 1 | −1 | 1 | −1 | 1 | −1 | 0 | −2 | −2 |
| R3C4 | −1 | 1 | −1 | 1 | −1 | 1 | −1 | 1 | 2 | −4 | 0 |

| | | | | | | | | | | |
|---|---|---|---|---|---|---|---|---|---|---|
| | | | | Data | | | | | | |
| ON | −1 | 1 | −1 | 1 | −1 | 1 | −1 | 1 | −1 | 1 |
| OFF | 1 | −1 | 1 | −1 | 1 | −1 | 1 | −1 | 1 | −1 |
| | | | | Strobe | | | | | | |
| R1 | 0 | 0 | 0 | 0 | 0 | 1 | −3 | −1 | 3 | 0 | 1 |
| R2 | 0 | 0 | 0 | 0 | 1 | −3 | −1 | 3 | 0 | 0 | 0 |
| R3 | 3 | 0 | 0 | 0 | 0 | 0 | 0 | 0 | 0 | 0 | 0 |
| R4 | 0 | 1 | −3 | −1 | 3 | 0 | 0 | 0 | 0 | 0 | |
| | Waveforms at x,y intersections for the display of FIG. 3 | | | | | | | | | | |
| R1C1 | 1 | −1 | 1 | −1 | 1 | 0 | −2 | −2 | 4 | −1 |
| R2C2 | −1 | 1 | −1 | 1 | −1 | 1 | −1 | 1 | −1 | 2 |
| R3C3 | 4 | 1 | −1 | 1 | −1 | 1 | −1 | 1 | −1 | 1 |
| R3C4 | 2 | −1 | 1 | −1 | 1 | −1 | 1 | −1 | 1 | −1 |

TABLE 6

| | | | | | | | | | | | | | | | | | | |
|---|---|---|---|---|---|---|---|---|---|---|---|---|---|---|---|---|---|---|
| | | | | | | | | | Data | | | | | | | | | |
| On | −1 | 1 | −1 | 1 | −1 | 1 | −1 | 1 | −1 | 1 | −1 | 1 | −1 | 1 | −1 | 1 | −1 | 1 |
| Off | 1 | −1 | 1 | −1 | 1 | −1 | 1 | −1 | 1 | −1 | 1 | −1 | 1 | −1 | 1 | −1 | 1 | −1 |
| | | | | | | | | | Strobe | | | | | | | | | |
| R1 | −3 | 1 | 3 | −1 | 0 | 0 | 0 | 0 | 0 | 0 | 0 | 0 | 0 | 0 | 0 | 0 | −3 | 1 |
| R2 | 0 | 0 | 0 | 0 | −3 | 1 | 3 | −1 | 0 | 0 | 0 | 0 | 0 | 0 | 0 | 0 | 0 | 0 |
| R3 | 0 | 0 | 0 | 0 | 0 | 0 | 0 | 0 | −3 | 1 | 3 | −1 | 0 | 0 | 0 | 0 | 0 | 0 |
| R4 | 0 | 0 | 0 | 0 | 0 | 0 | 0 | 0 | 0 | 0 | 0 | 0 | −3 | 1 | 3 | −1 | 0 | 0 |
| | | | | | | | | | Waveform at x,y intersection for the display of FIG. 3 | | | | | | | | | |
| R1C1 | −2 | 0 | 4 | −2 | 1 | −1 | 1 | −1 | 1 | −1 | 1 | −1 | 1 | −1 | 1 | −1 | −2 | 0 |
| R2C2 | −1 | 1 | −1 | 1 | −4 | 2 | 2 | 0 | −1 | 1 | −1 | 1 | −1 | 1 | −1 | 1 | −1 | 1 |
| R3C3 | −1 | 1 | −1 | 1 | −1 | 1 | −1 | 1 | −2 | 0 | 4 | −2 | −1 | 1 | −1 | 1 | −1 | 1 |
| R3C4 | 1 | −1 | 1 | −1 | 1 | −1 | 1 | −1 | −4 | 2 | 2 | 0 | 1 | −1 | 1 | −1 | 1 | −1 |

TABLE 7

| | | | | | | | | | | | | | | | | | | |
|---|---|---|---|---|---|---|---|---|---|---|---|---|---|---|---|---|---|---|
| | | | | | | | | | Data | | | | | | | | | |
| ON | 1 | −1 | 1 | −1 | 1 | −1 | 1 | −1 | 1 | −1 | 1 | −1 | 1 | −1 | 1 | −1 | 1 | −1 |
| OFF | −1 | 1 | −1 | 1 | −1 | 1 | −1 | 1 | −1 | 1 | −1 | 1 | −1 | 1 | −1 | 1 | −1 | 1 |
| | | | | | | | | | Strobe | | | | | | | | | |
| R1 | −1 | −3 | 1 | 0 | 0 | 0 | 0 | 0 | 0 | 0 | 0 | 0 | 0 | 0 | 0 | 0 | −1 | −3 |
| R2 | 0 | 0 | 0 | 0 | −1 | −3 | 1 | 3 | 0 | 0 | 0 | 0 | 0 | 0 | 0 | 0 | 0 | 0 |
| R3 | 0 | 0 | 0 | 0 | 0 | 0 | 0 | 0 | −1 | −3 | 1 | 3 | 0 | 0 | 0 | 0 | 0 | 0 |
| R4 | 0 | 0 | 0 | 0 | 0 | 0 | 0 | 0 | 0 | 0 | 0 | 0 | −1 | −3 | 1 | 3 | 0 | 0 |
| | | | | | | | | | Waveform at x,y intersection for the display of FIG. 3 | | | | | | | | | |
| R1C1 | −2 | −2 | 0 | 4 | −1 | 1 | −1 | 1 | −1 | 1 | −1 | 1 | −1 | 1 | −1 | 1 | −2 | −2 |
| R2C2 | 1 | −1 | 1 | −1 | 0 | −4 | 2 | 2 | 1 | −1 | 1 | −1 | 1 | −1 | 1 | −1 | 1 | −1 |
| R3C3 | 1 | −1 | 1 | −1 | 1 | −1 | 1 | −1 | −2 | −2 | 0 | 4 | 1 | −1 | 1 | −1 | 1 | −1 |

TABLE 7-continued

| | | | | | | | | | | | | | | | | | | |
|---|---|---|---|---|---|---|---|---|---|---|---|---|---|---|---|---|---|---|
| R3C4 | −1 | 1 | −1 | 1 | −1 | 1 | −1 | 0 | −4 | 2 | 2 | −1 | 1 | −1 | 1 | −1 | 1 | |

TABLE 8

| | | | | | | | | | | | | | | | | | | |
|---|---|---|---|---|---|---|---|---|---|---|---|---|---|---|---|---|---|---|
| | | | | | | | | | Data | | | | | | | | | |
| ON | −1 | 1 | −1 | 1 | −1 | 1 | −1 | 1 | −1 | 1 | −1 | 1 | −1 | 1 | −1 | 1 | −1 | 1 |
| OFF | 1 | −1 | 1 | −1 | 1 | −1 | 1 | −1 | 1 | −1 | 1 | −1 | 1 | −1 | 1 | −1 | 1 | −1 |
| | | | | | | | | | Strobe | | | | | | | | | |
| R1 | −3 | −1 | 3 | 1 | 0 | 0 | 0 | 0 | 0 | 0 | 0 | 0 | 0 | 0 | 0 | 0 | −3 | −1 |
| R2 | 0 | 0 | 0 | 0 | −3 | −1 | 3 | 1 | 0 | 0 | 0 | 0 | 0 | 0 | 0 | 0 | 0 | 0 |
| R3 | 0 | 0 | 0 | 0 | 0 | 0 | 0 | 0 | −3 | −1 | 3 | 1 | 0 | 0 | 0 | 0 | 0 | 0 |
| R4 | 0 | 0 | 0 | 0 | 0 | 0 | 0 | 0 | 0 | 0 | 0 | 0 | −3 | −1 | 3 | 1 | 0 | 0 |
| | | | | | | | | | Waveform at x,y intersection for the display of FIG. 3 | | | | | | | | | |
| R1C1 | −2 | −2 | 4 | 0 | 1 | −1 | 1 | −1 | 1 | −1 | 1 | −1 | 1 | −1 | 1 | −1 | −2 | −2 |
| R2C2 | −1 | 1 | −1 | 1 | −4 | 0 | 2 | 2 | −1 | 1 | −1 | 1 | −1 | 1 | −1 | 1 | −1 | 1 |
| R3C3 | −1 | 1 | −1 | 1 | −1 | 1 | −1 | 1 | −2 | −2 | 4 | 0 | −1 | 1 | −1 | 1 | −1 | 1 |
| R3C4 | 1 | −1 | 1 | −1 | 1 | −1 | 1 | −1 | −4 | 0 | 2 | 2 | 1 | −1 | 1 | −1 | 1 | −1 |

The curve shown in FIG. 5 is affected by a number of factors. For good multiplexing a curve with a minimum value of the V.t product is required. The minimum theoretical value of V.t for the materials described above is given as $$Emin = Ps/\sqrt{3}\ \epsilon o \cdot \epsilon \sin^2\theta$$

where

Ps is spontaneous polarisation coeficient, $\epsilon_o$=permittivity of free space $\Delta\epsilon$=dielectric anisotropy of liquid crystal material $\theta$=cone angle of ferro electric liquid crystal material.

This applies to the case of homogeneous alignment of the liquid crystal molecules. In a practical device where there is likely to be tilt in the bulk of the liquid crystal layer Emin is higher than this value.

Figure 6:
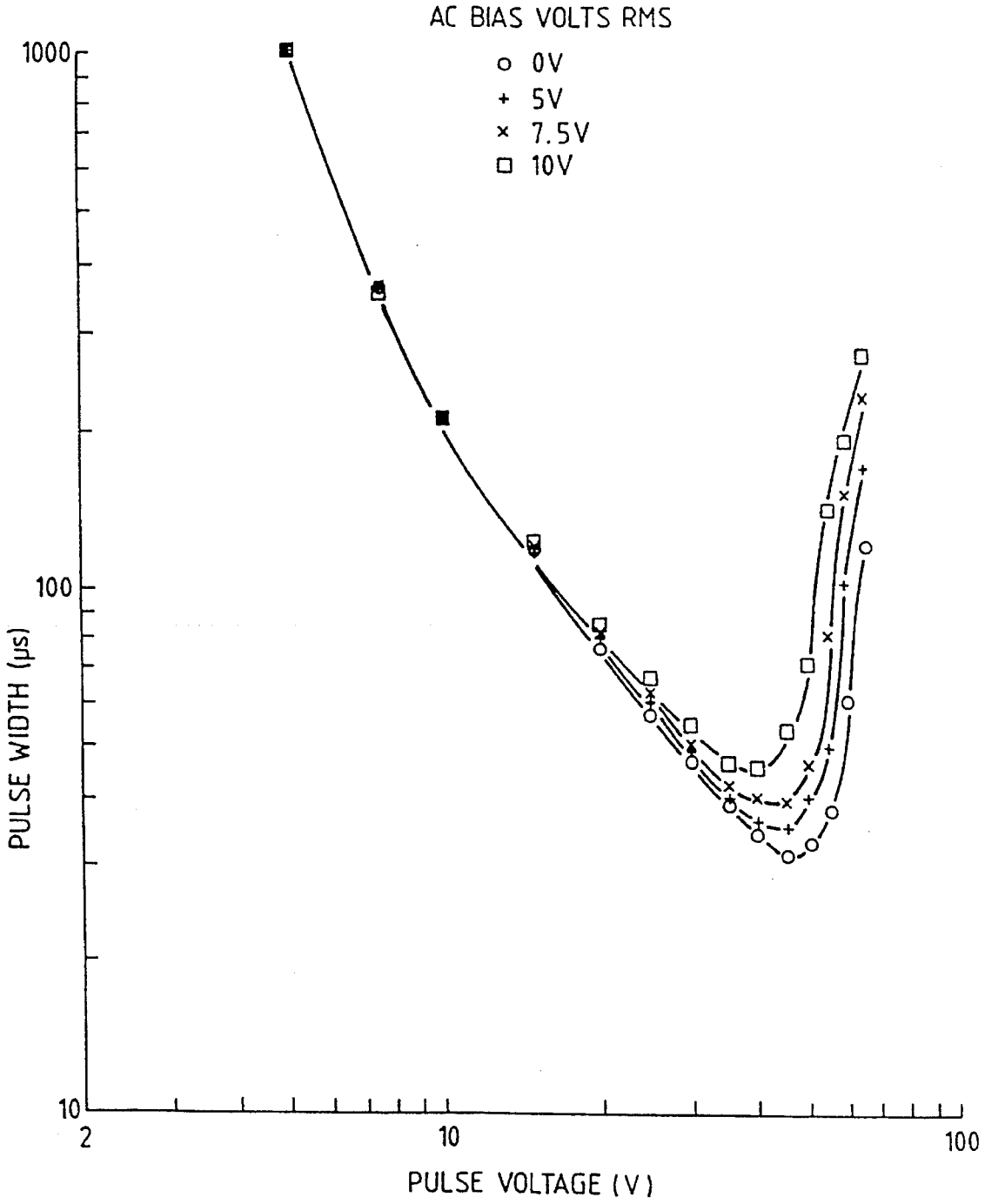
FIG. 6 is a graph of applied voltage vs switching times for different values of applied a.c. bias voltage.

FIG. 6 shows how the value of Emin is moved upwards and to the left as the amount of applied A.C. voltage, i.e. the data voltage, is increased. The reason for this is the interaction of the applied field with the negative dielectric anisotropy of the liquid crystal material. Such interaction tends to move the liquid crystal material from a tilted to a more homogeneous structure. The liquid crystal material used is LPM 68 in a layer 1.7 μm thick at a temperature of 20° C.

Figure 7:
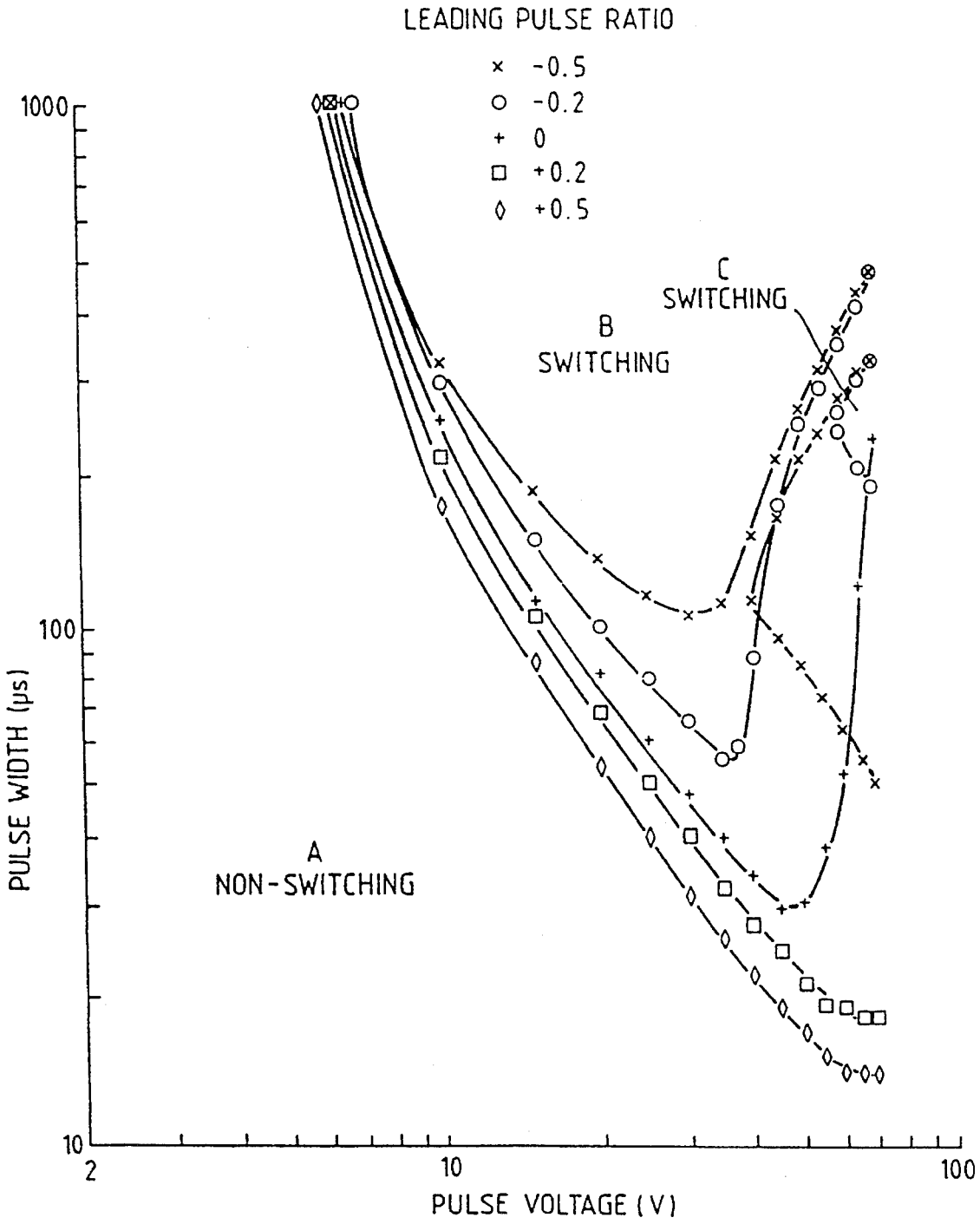
FIG. 7 is a graph of applied voltage vs switching times for different values of leading pulse ratio.
Figure 8A:
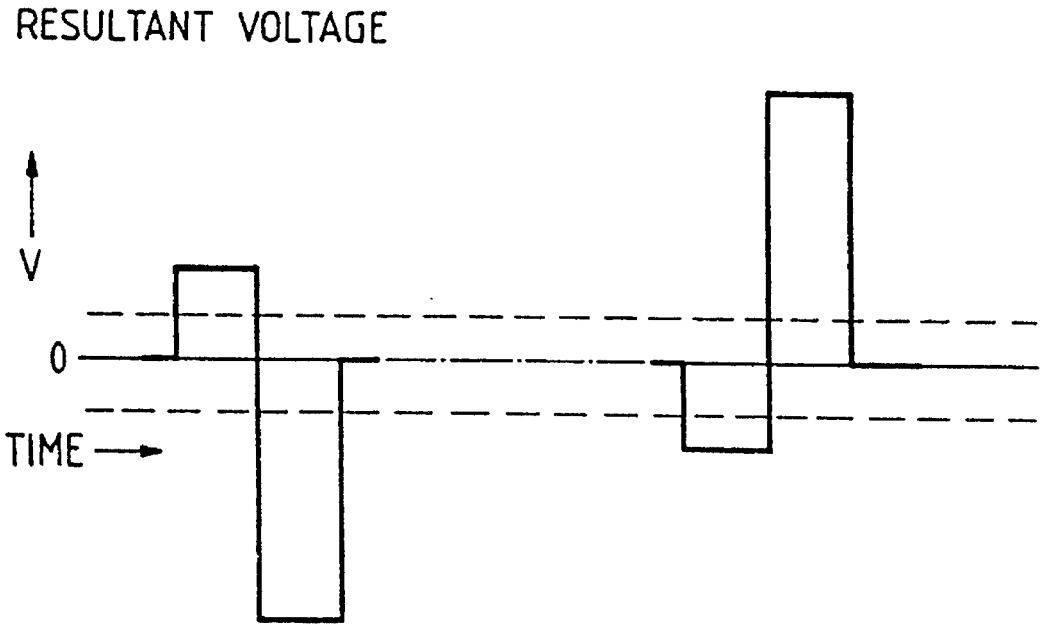
FIGS. 8(*a*) and 8(*b*) show waveform traces having positive and negative leading pulse ratios as used for measurement of the curves shown in FIG. 7.
Figure 8B:
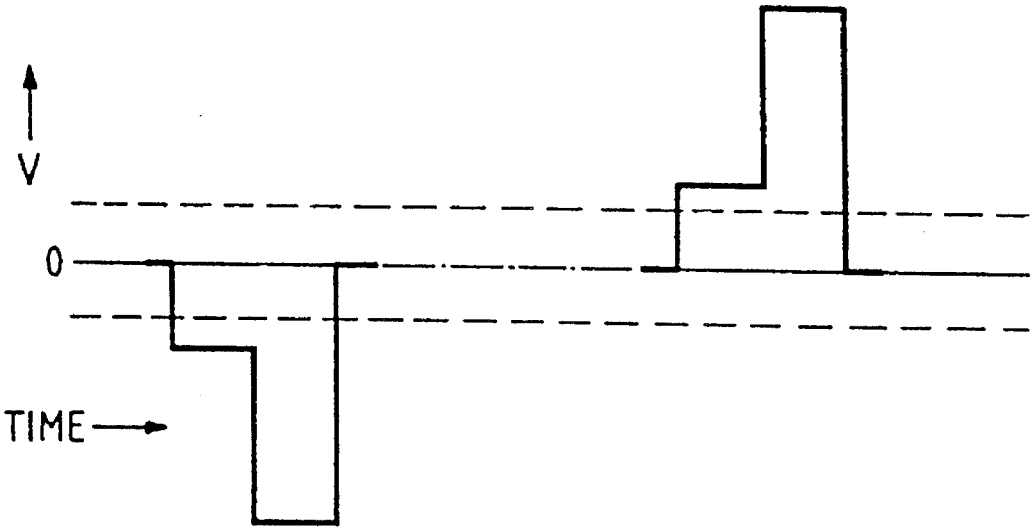

FIG. 7 shows the effect of varying the amplitude and magnitude of the leading pulse in each pair of strobe pulses. The voltage at each electrode intersection, or pixel, is the difference between data and strobe voltages i.e. the resultant waveform. FIG. 8(*a*), (*b*) sow the resultant waveform at a pixel when addressed by a strobe pulse pair and data waveforms. In FIG. 8(*a*) the resultant waveform is a positive first or leading pulse followed by a negative second or trailing pulse; this is defined as a negative leading pulse ration because the magnitudes are of opposite sign. A negative leading pulse followed by a positive trailing pulse also has a negative leading pulse ratio. In contrast FIG. 8(*b*) shows a waveform with both pulses of the same sign; this is defined as a positive leading pulse ratio. A zero leading pulse ratio will have a zero voltage level leading pulse. FIG. 7 shows V.t curves for resultant waveforms with leading pulse ratios of −0.5, −0.2, 0, 0.2, and 0.5. The material and cell are as in FIG. 6 but at a temperature of 30° C. and with no A.C. bias. Region marked A is non switching (or partial switching), region B is switching by the trailing pulse, and region C is switching by leading pulse.

Figure 9:
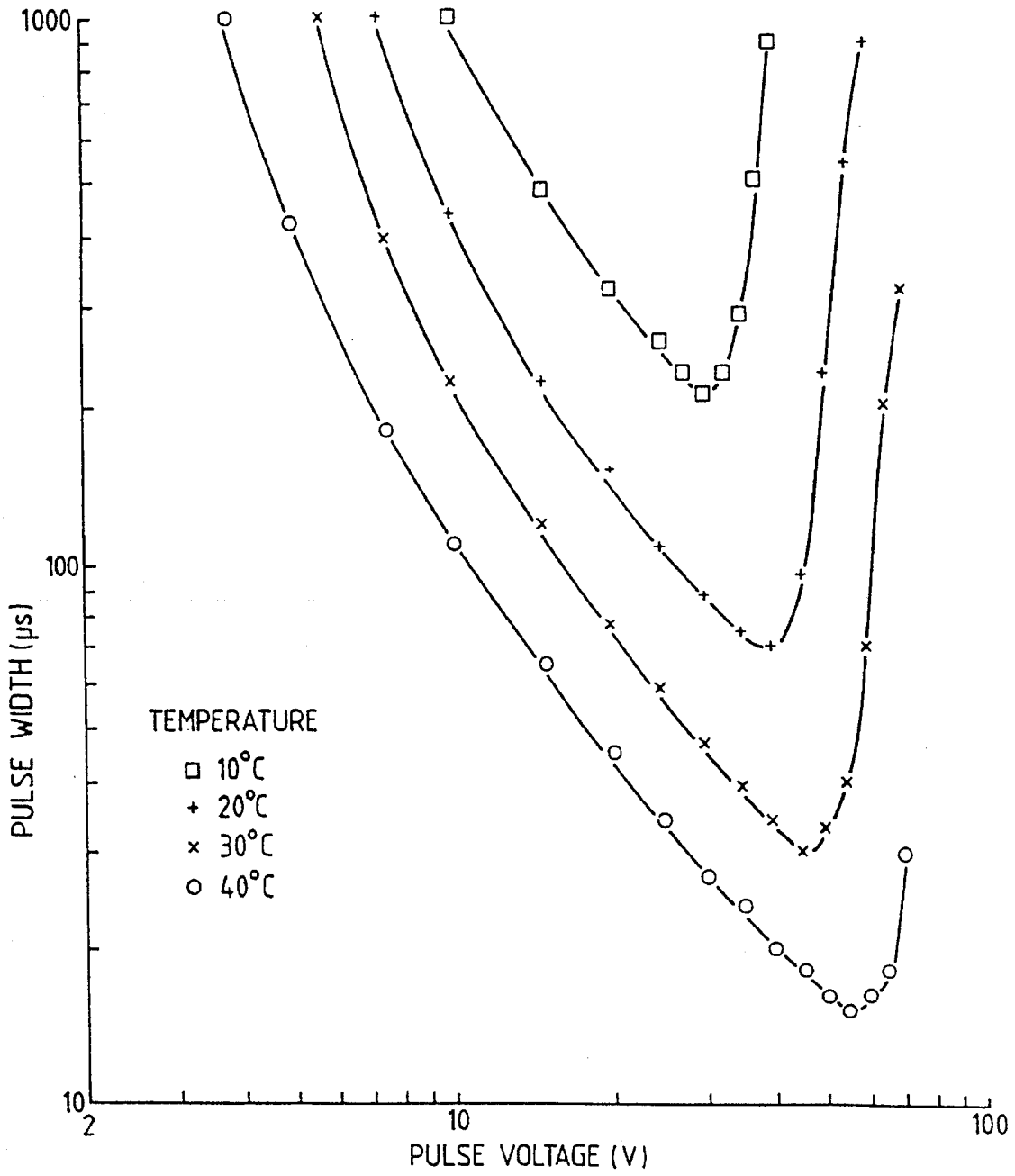
FIG. 9 is a graph of applied voltage vs switching times for different liquid crystal temperatures.

FIG. 9 shows how the V.t curve is affected by temperature. The curves are for temperatures of 10°, 20°, 30°, and 40° C.; the cell material and thickness are as for FIG. 7. The value of Emin occurs at lower response times but higher voltages as temperature increases.

Using the above changes in the V.t curve characteristics, temperature compensation can be built into the display of FIG. 1. This is achieved by measuring the temperature of the liquid crystal material with the thermocouple 15 (FIG. 1) and varying the amplitude and sign of the leading pulse in the strobe pulse pair. Using a negative leading pulse ration the value of Emin can be moved to a lower voltage at a correspondingly higher response time. Using a positive leading pulse ration Emin can be moved to a faster response time at a correspondingly higher voltage.

By way of example a 16 by 16 pixel matrix cell was made using the material LPM 68 in a 1.7 μm thick layer constructed as for FIG. 2. The applied waveforms were as in FIG. 4 with data voltage Vd of 5 volts amplitude, trailing strobe pulse voltage Tp of 40 volts, a variable leading pulse voltage Lp, and time slots of 60 μs whilst simulating 32 way multiplexing. Temperature and leading pulse Lp were varied as in Table 9. A clear, good contrast, display was obtained at all temperature points with the listed leading pulse voltages.

TABLE 9

| Temperature | | | Resultant Waveform Ratio | |
|---|---|---|---|---|
| °C. | Lp volts | Lp/Tp Ratio | Vx | Vy |
| 15 | 4 | 0.1 | −0.02 | 0.26 |
| 19.7 | −4 | −0.1 | −0.2 | +0.03 |
| 25.5 | −8 | −0.2 | | |
| 30 | −12 | −0.3 | −0.38 | −0.2 |
| 34.1 | −16 | −0.4 | | |
| 36.2 | −20 | −0.5 | | |
| 38.3 | −28 | −0.7 | −0.73 | −0.66 |
| 39.4 | −32 | −0.8 | | |
| 45 | −40 | −1.0 | −0.78 | −1.0 |

Vx, Vy = ratio of leading pulse to trailing pulse of resultant waveform in the two strobe pulse pairs.

Taking the three temperature values of 19.7, 30, 38.3° C. the data, strobe, and resultant waveform are shown in the following table, using the format of Table 1 for a 4×4 matrix.

TABLE 10

| Numbers are d.c. voltage levels | | | | | | | | | | | | |
|---|---|---|---|---|---|---|---|---|---|---|---|---|
| Data | 5 | −5 | 5 | −5 | 5 | −5 | 5 | −5 | 5 | −5 | 5 | −5 |
| Temperature 19.7° C. | | | | | | | | | | | | |
| Strobe | −4 | 40 | 0 | 0 | 0 | 0 | 0 | 0 | 4 | −40 | 0 | 0 |
| Resultant | −9 | 45 | −5 | 5 | −5 | 5 | −5 | 5 | −1 | −35 | −5 | 5 |
| Temperature 30° C. | | | | | | | | | | | | |
| Strobe | −12 | 40 | 0 | 0 | 0 | 0 | 0 | 0 | 12 | −40 | 0 | 0 |
| Resultant | −17 | 45 | −5 | 5 | −5 | 5 | −5 | 5 | 7 | −35 | −5 | 5 |
| Temperature 38.3° C. | | | | | | | | | | | | |
| Strobe | −28 | 40 | 0 | 0 | 0 | 0 | 0 | 0 | 28 | −40 | 0 | 0 |
| Resultant | −33 | 45 | −5 | 5 | −5 | 5 | −5 | 5 | 23 | −35 | −5 | 5 |

From this the result of a strobe pair pulse at 19.7° C. gives a resultant pulse pair of −9, 45 and later −1, −35. This gives a leading pulse ration of −9/45=−0.2, and −1/−35=0.03. Note these two ratios are the same when the inverse of the data waveform is used. The data waveform and its inverse are used depending upon whether a pixel is to be switched to an ON or OFF state. The leading pulse ratios can be calculated for the other temperature values; the results are given in Table 9.

Figure 10:
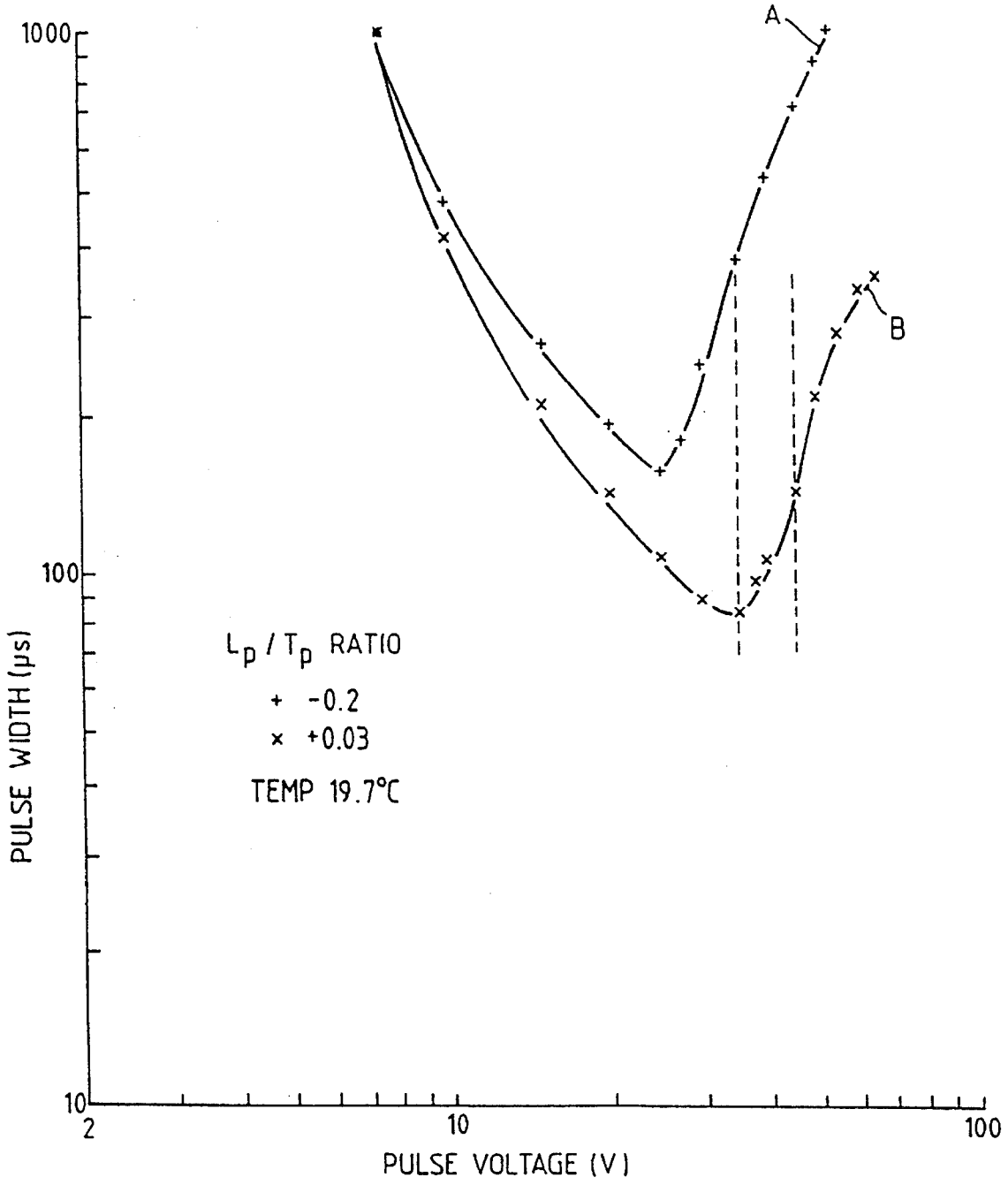
FIGS. 10, 11, 12 shows graphs of applied voltage vs switching times at different temperatures and show the effect of varying leading pulse ratios to provide temperature compensation.
Figure 11:
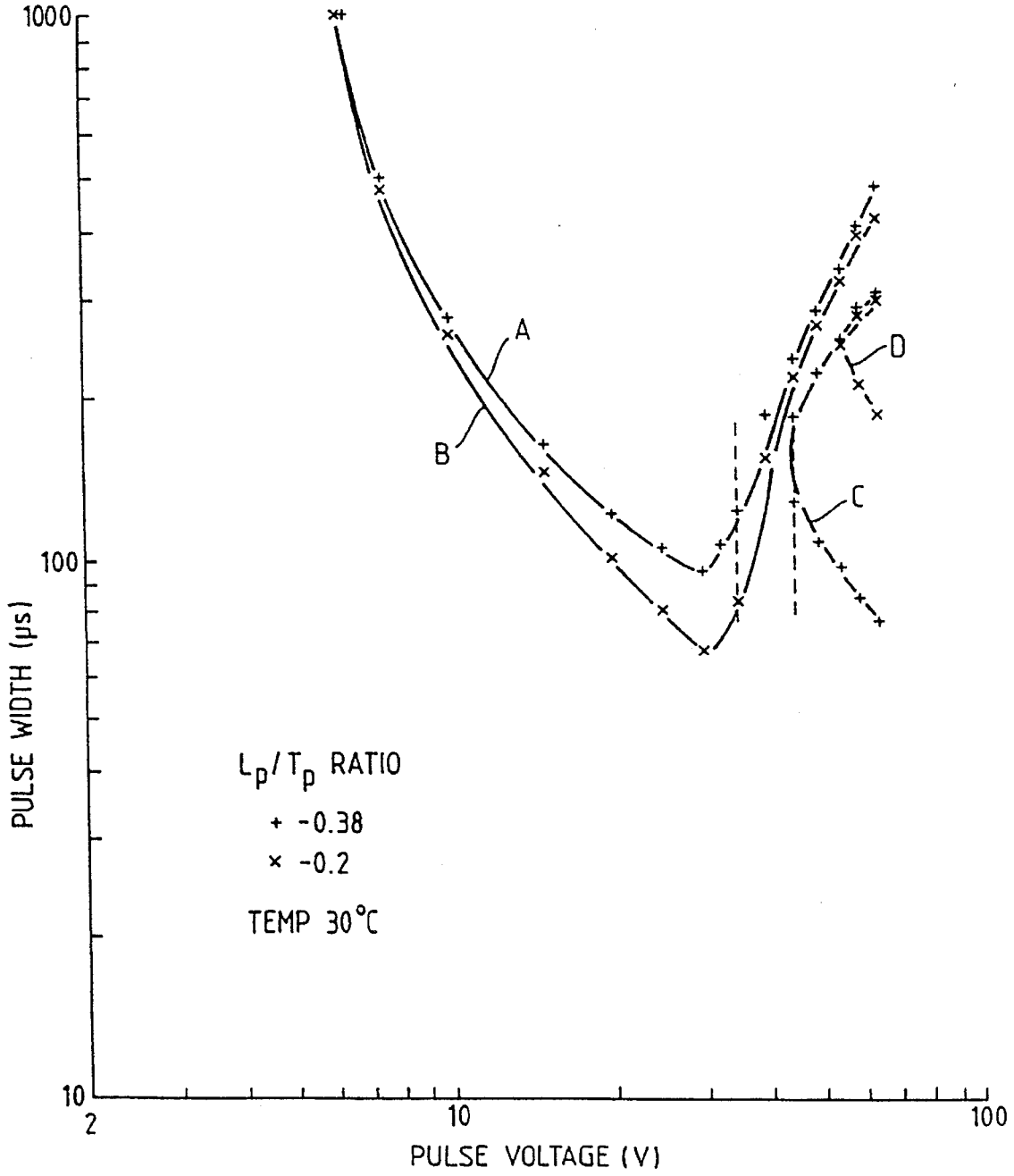
Figure 12:
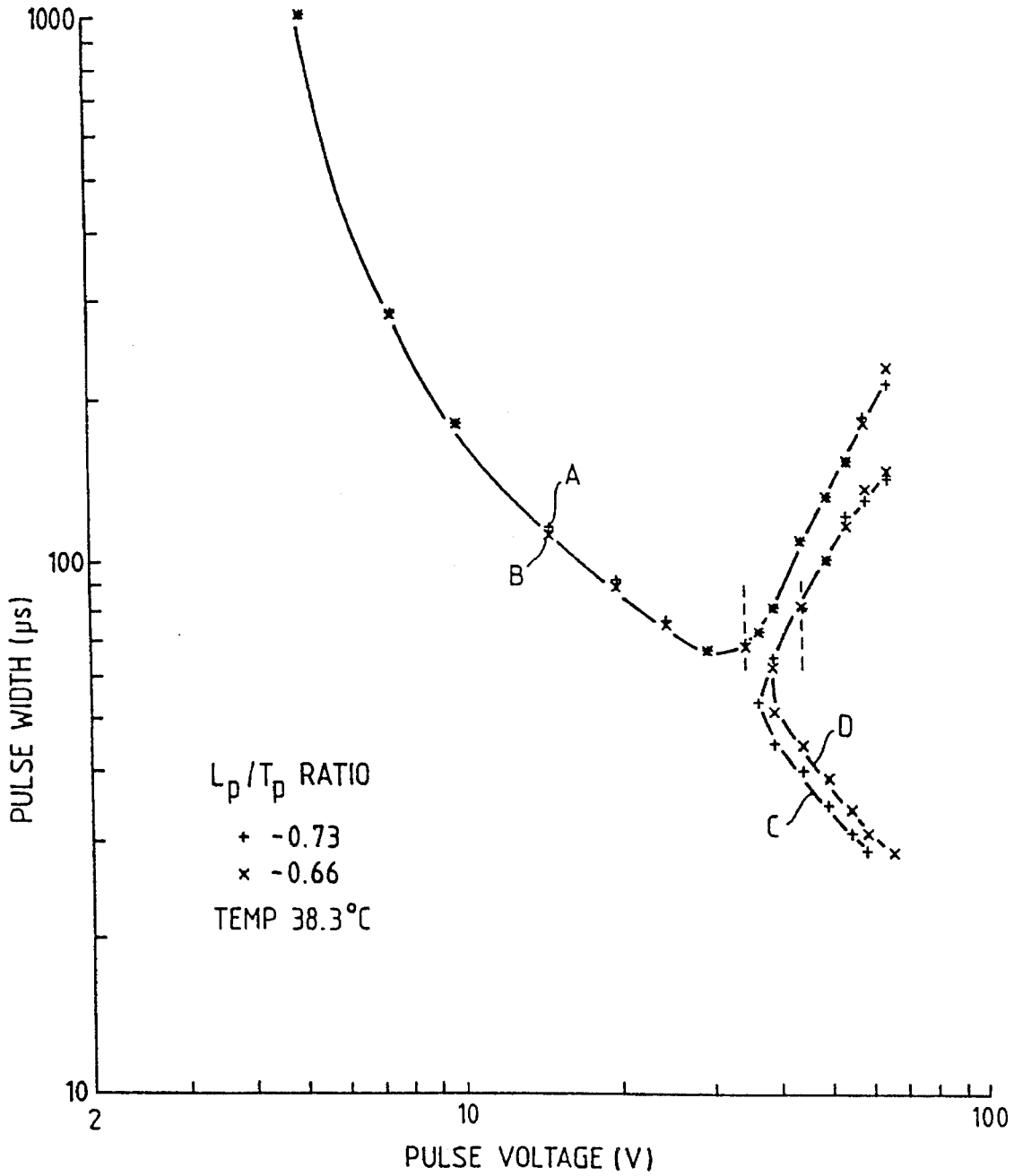

Taking the leading pulse ratios in Table 9 V.t plots have been determined for the three temperatures 19.7, 30, 38.3° C. and the results are shown in FIGS. 10, 11, 12 respectively. Each case curve A shows the response to the first strobe pulse pair, and curve B the response to the second strobe pulse pair.

Looking first at FIG. 10 the first strobe pulse pair gives a resultant waveform of −9 then 45 volts, i.e. a leading pulse ratio of −0.2, and curve A applies. Thus a voltage of 45 (preceded by −9) for less than about 700 μs will not switch. Looking now at the second strobe pulse pair the resultant waveform is −1 then −35 volts, i.e. a leading pulse ration of 0.03, and curve B applies. Thus a voltage of (−)35 preceded by (−)1 will switch the material if the slot time is greater than about 80 μs. The voltage levels of 45 and (−)35 are be marked on FIG. 10 as vertical lines with a band of time slots. Clear and clean switching is obtained for time slots of about 70 to 400 μs. The bands start slightly below the V.t curves because in practice optical switching is observed at the marked values.

Similarly in FIG. 11 curve A applies to the resultant waveform of the first strobe pulse pair where Vx=−0.38, and curve B applies to the second strobe pulse pair where Vy=−0.2. A voltage of 45 volts, preceded by −17 volts, does not switch providing the time slot is less than about 180 μs. A voltage of −35 preceded by 7 volts switches providing the time slot is greater than about 80 μs. Clear and clean switching is available for time slots of about 80 to 180 μs.

Looking first at FIG. 10 the first strobe pulse pair gives a resultant waveform of −9 then 45 volts, i.e. a leading pulse ratio of −0.2, and curve A applies. Thus a voltage of 45 ) preceded by −9) for less than about 700 μs will not switch. Looking now at the second strobe pulse pair the resultant waveform is −1 then −35 volts, i.e. a leading pulse ratio of 0.03, and curve B applies. Thus a voltage of (−)35 preceded by (−)1 will switch the material if the slot time is greater than about 80 μs. The voltage levels of 45 and (−)35 are be marked on FIG. 10 as vertical lines with a band of time slots. Clear and clean switching is obtained for time slots of about 70 to 400 μs. The bands start slightly below the V.t curves because in practice optical switching is observed at the marked values.

Similarly in FIG. 11 curve A applies to the resultant waveform of the first strobe pulse pair where Vx=−0.38, and curve B applies to the second strobe pulse pair where Vy=−0.2. A voltage of 45 volts, preceded by −17 volts, does not switch providing the time slot is less than about 180 μs. A voltage of −35 preceded by 7 volts switches providing the time slot is greater than about 80 μs. Clear and clean switching is available for time slots of about 80 to 180 μs.

Two additional curves are marked C, D for the resultant leading pulse ratios of −0.32 and −0.2 respectively. The C, D curves are plots of the trailing pulse V.t values for resultant pulse pairs that switch the cell on leading pulses. This contrasts with the previous resultant waveforms where the cell always switched on a trailing pulse. It seems unpredictable that a cell should switch on receipt of a small resultant leading pulse and not switch on the larger value trailing pulse. However, this is an observed phenomenon and is due to molecules relaxing immediately prior to receiving the leading pulse. After such relaxation the small leading pulse is able to switch itself fully, but the cell cannot fully switch again within the available time slot of the larger amplitude trailing pulse.

For example a given pixel switched by a −35 volts, preceeded by 7 volts (curve B) also receives 45 volts preceeded by −35 volts and no switching on the trailing pulse of 45 volts occurs because it is below curve A. However, 45 volts lies within the switching area of curve C for time slots of about 130–180 μsecs. Thus the leading pulse of −35 volts preceeding 45 volts switches or reinforces the given pixel also switched to the same state by the −35 volts trailing pulse. The net effect of curves C, D in FIG. 11 is to reinforce the switching already described for curves A, B within a limited range of time slots.

Again in FIG. 12 curve A applies to the resultant waveform of the fist strobe pulse pair where Vx=−0.73, and curve B applies to the second strobe pulse pair where Vy=−0.66. A voltage of 45 volts, preceded by −33 volts, does not switch providing the time slot is less than about 80 us. A voltage of −35 preceded by 23 volts switches providing the time slot is greater than about 63 μs. Clear and clean switching is available for time slots of about 63 to 80 μs. Curves C, D show curves for leading pulse switching as in FIG. 11. These reinforce the leading pulse switching of curves A, B.

Not shown by Figures but listed in Table 9 are details obtained for the temperature by 15° C. This was found to be multiplex addressable for time slot periods of about 70 to 200 μs.

The above shows how a given cell can be satisfactorily addressed over a temperature range of 10° to 40° C. merely by changing the amplitude of the leading strobe pulse in each strobe pair from +8 volts to −32 volts, the + or − sign representing the same or opposite polarity as the trailing pulse voltage of +40 volts. These values represent leading pulse ratios Lp/Tp of +0.2 to −0.8.

As a further example the above cell with material LPM 68 was operated under the following conditions and the following results obtained:

Strobe trailing pulse voltage Vs=15 volts, data pulse Vd=5 volts, and a 120 μs time slot.

TABLE 11

| Temperature | | Leading pulse volts | Lp/Tp ratio | Vx | Vy |
|---|---|---|---|---|---|
| 15 | 12 | 0.8 | 0.35 | 1.7 | |
| 20 | 5 | 0.33 | 0 | 1.0 | |
| 25 | 0 | −0.25 | −0.25 | 0.5 | |
| 30 | −6 | −0.4 | −0.55 | −0.1 | |
| 35 | −15 | −1 | −1 | −1 | |

Note the levels of resultant voltages are below Emin on the graphs of FIGS. 6 to 11. Temperature compensation is applicable for displays operating both above and below Emin.

Thus to provide compensation for liquid crystal temperature variation the strobe waveform generator is programmed to output strobe pulses with a ratio that varies with the liquid crystal temperature. Different materials and cell thickness will have different characteristics that need to be predetermined.

Observation of Tables 9 and 11 show the Lp/Tp ratio to be approximately linearly related to temperature. Thus the output of the thermocouple 15 can be fed to an inverting amplifier for controlling the amplitude of the leading pulse in each strobe pair. Alternatively a ROM chip can be programmed to output the required leading pulse voltage level for a predetermined set of different temperatures inputs.

All the above strobe waveforms use identical but opposite polarity first and second pulse pairs. In a modification the strobe leading pulse ratio Lp/Tp is varied between the first and second pulse pair. This has the effect of increasing the separation between the curves A, B in FIGS. 10 to 12. The resulting small d.c. bias is removed by periodically reversing display polarity.

In a modification the values of the data pulse pair may be varied in field 1 and field 2 to improve the separation of curves A and B in FIGS. 10–12. This may be achieved either in conjunction with variation of the leading part of the strobe pulse pair or independently of it and may take a number of forms:

(i) an equal reduction in amplitude of each of the first pair of data pulses with a corresponding increase in the amplitude of the second pair;

(ii) an equal increase in amplitude of each of the first pair of data pulses with a corresponding decrease in the amplitude of the second pair;

(iii) an increase in the amplitude of the first pulse of the first pair of data pulses with a corresponding decrease in amplitude of the first pulse of the second pair;

(iv) a decrease in the amplitude of the first pulse of the first pair of data pulses with a corresponding increase in amplitude of the first pulse of the second pair (v) and (vi) vary second pulse of the pair.

In a further modification the first strobe pair is replaced by a blanking pulse that completely switches to one state a line at a time. Alternatively a group of lines or the whole display can be blanked at one time. Pixels requiring to be switched to the other state are switched by the remaining strobe pulse pair. The resulting d.c. bias is removed by periodically reversing polarity. Use of blanking eliminates the first field in the addressing and reduces the complete addressing time.

I claim:

1. A multiple addressed liquid crystal display comprising:

a liquid crystal cell including a layer of ferro-electric smectic liquid crystal material contained between two walls, each wall bearing a set of electrodes, said electrodes in combination comprising a matrix of addressable intersections;

driver circuits for applying data waveforms to one set of electrodes and blanking and strobe waveforms to the other set of electrodes in a multiplexed manner;

waveform generators for generating data and blanking and strobe waveforms for applying to the drive circuits; and means for controlling the order of data waveforms so that a desired display pattern is obtained, said waveform generators including:

a data waveform generator means for generating two continuous sets of data waveforms of equal amplitude and frequency but opposite sign, each data waveform comprising continuous d.c. pulses of alternate sign, each pulse having a single time slot duration ts;

a blanking waveform generator for generating a blanking waveform; and a strobe waveform generator means for generating strobe waveforms comprising a pair of strobe pulses of different amplitude, each strobe pulse having a duration coincident with and equal to said time slot duration ts.

2. The display of claim 1 wherein the blanking waveform generated by said blanking waveform generator means is separated from the pair of strobe pulses by a number of time periods when a zero strobe pulse is generated.

3. The display of claim 1 wherein the blanking pulse and pair of strobe pulses immediately follow one another in time.

4. The display of claim 1 wherein said strobe waveform generator means includes means for varying at least one of amplitude and sign of the leading pulse with reference to the trailing pulse.

5. The display of claim 1 further comprising:

a temperature sensing element for sensing the liquid crystal layer temperature; and means for varying amplitude and sign of the leading pulse voltage in each strobe pulse pair to compensate for temperature variation in the liquid crystal layer.

6. The display of claim 1 wherein said strobe waveform generator means includes means for independently varying at least one of amplitude and sign of a leading pulse in each strobe pulse pair for compensation of temperature variation in the liquid crystal material.

7. The display of claim 1 wherein said data waveform generator means includes means of varying amplitude of the data waveform.

8. A method of multiplex addressing a ferro-electric liquid crystal matrix display formed by the intersections of a first set of electrodes and a second set of electrodes, said method comprising the steps of:

applying a blanking waveform to each electrode in sequence in the first set of electrodes, said blanking waveform comprising a plurality of d.c. pulse of similar sign;

applying a strobe waveform to each electrode in sequence in the first set of electrodes, said strobe waveform comprising a pair of strobe pulses of different amplitude, each strobe pulse lasting a single time slot duration ts; and applying one of two data waveforms to each electrode in the second set of electrodes coincidentally with the strobe waveform, both data waveforms being rectangular waveforms of alternate positive and negative values with one data waveform the inverse of the other data waveform, each data waveform value lasting a single time slot duration ts, wherein each intersection is addressed with a d.c. pulse of appropriate sign and magnitude to turn the intersection to a desired display state once per complete display address period.

9. The method of claim 8 wherein the leading pulse in each strobe pulse pair is varied in amplitude and sign to compensate for temperature variation in the liquid crystal material.

10. The method of claim 8 wherein the amplitude of the data waveform is varied to compensate for temperature variation in the liquid crystal material.

11. A multiple addressed liquid crystal display comprising:

a liquid crystal cell including a layer of ferro-electric smectic liquid crystal material contained between two walls, each wall bearing a set of electrodes, said electrodes in combination comprising a matrix of addressable intersections;

driver circuits for applying data waveforms to one set of electrodes and blanking and strobe waveforms to the other set of electrodes in a multiplexed manner;

waveform generators for generating data, blanking and strobe waveforms for applying to the drive circuits;

means for controlling the order of data waveforms so that a desired display pattern is obtained; and means for sensing the liquid crystal temperature, said waveform generators include:

a data waveform generator means for generating two sets of data waveforms of equal amplitude and frequency but opposite sign, each data waveform comprising d.c. pulses of alternate sign, each pulse lasting for a single time slot duration ts;

a blanking waveform generator for generating blanking waveforms; and a strobe waveform generator means, responsive to said temperature sensing means, for generating strobe waveforms comprising a pair of strobe pulses of different amplitude, each strobe pulse having a duration coincident with and equal to said time slot duration ts, where amplitude and sign of a leading pulse in each strobe pulse pair is independently variable in response to sensed liquid crystal temperature to compensate for changes in liquid crystal temperature.

12. The display of claim 1 and further including means for periodically reversing polarity of data, blanking and strobe waveforms to provide an overall net zero d.c. value.

13. The display of claim 1 wherein the driver circuits apply blanking pulses to one line while the strobe waveform is being applied to a previously blanked line.

14. The display of claim 1 wherein the blanking waveform comprises a main pulse of one polarity and adjacent smaller pulses of opposite polarity, which, in combination with the strobe pulse pair, net zero d.c. bias.

* * * * *